US008462039B2

(12) United States Patent
Park et al.

(10) Patent No.: US 8,462,039 B2
(45) Date of Patent: Jun. 11, 2013

(54) INDOOR ELECTROMAGNETIC ENVIRONMENT IMPLEMENTING STRUCTURE AND A CONSTRUCTING METHOD THEREOF

(75) Inventors: Sangmyeong Park, Cheongju-si (KR); Je Hoon Yun, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 364 days.

(21) Appl. No.: 12/852,040

(22) Filed: Aug. 6, 2010

(65) Prior Publication Data

US 2011/0133977 A1 Jun. 9, 2011

(30) Foreign Application Priority Data

Dec. 9, 2009 (KR) ..... 10-2009-0121977
Apr. 22, 2010 (KR) ..... 10-2010-0037563

(51) Int. Cl.
*H01Q 17/00* (2006.01)

(52) U.S. Cl.
USPC ..... 342/4

(58) Field of Classification Search
USPC ..... 342/1–4
See application file for complete search history.

(56) References Cited

U.S. PATENT DOCUMENTS 3,113,271 A * 12/1963 Buckley ..... 455/63.1
3,120,641 A * 2/1964 Buckley ..... 455/128
3,273,150 A * 9/1966 Emerson ..... 342/4
3,806,943 A * 4/1974 Holloway ..... 343/703
4,387,786 A * 6/1983 Klipsch et al. ..... 181/150
4,931,798 A * 6/1990 Kogo ..... 342/4
4,972,191 A * 11/1990 Ishino et al. ..... 342/1
5,134,405 A * 7/1992 Ishihara et al. ..... 342/1
5,594,446 A * 1/1997 Vidmar et al. ..... 342/1
6,195,034 B1 * 2/2001 Tsuno et al. ..... 342/1
6,479,140 B1 * 11/2002 Takao et al. ..... 428/317.9
6,583,749 B2 * 6/2003 Aknin ..... 342/2

(Continued)

FOREIGN PATENT DOCUMENTS

KR 10-0474869 2/2005
KR 2009-0064727 A 6/2009
WO WO-02/056041 A1 7/2002
WO WO 2008069495 A1 * 6/2008

OTHER PUBLICATIONS

T. H. Lehman, et al., "Recent developments relevant to implementation of a hybrid TEM cell/reverberation chamber HIRF test facility", Digital Avionics Systems Conference, 1997. 16th DASC., AIAA/IEEE, vol. 1, pp. 4.2-26~30, Oct. 1997.

(Continued)

*Primary Examiner* — John B Sotomayor
(74) *Attorney, Agent, or Firm* — Rabin & Berdo, P.C.

(57) ABSTRACT

Disclosed is an indoor electromagnetic environment implementing structure. A shield room in a polyhedron structure for blocking electromagnetic waves output from the interior toward the exterior thereof and electromagnetic waves input from the exterior toward the interior when measuring a characteristic of the electromagnetic waves is installed, an electromagnetic wave absorber is installed at a door and a window on a wall through which the electromagnetic waves are output in the shield room, and a cover for covering the electromagnetic wave absorber with a size corresponding to the electromagnetic wave absorber is installed. In this instance, the cover transmits or blocks the electromagnetic waves according to utilization of electromagnetic wave measurement tests.

10 Claims, 5 Drawing Sheets

U.S. PATENT DOCUMENTS

| | | | | |
|---|---|---|---|---|
| 6,738,007 | B1 * | 5/2004 | Stafford | 342/3 |
| 6,756,931 | B2 * | 6/2004 | Mukasa et al. | 342/1 |
| 6,943,286 | B1 * | 9/2005 | Kurihara et al. | 174/390 |
| 7,551,117 | B2 * | 6/2009 | Asaba | 342/1 |
| 7,623,058 | B2 * | 11/2009 | Katano | 342/4 |
| 7,940,203 | B2 * | 5/2011 | Katano et al. | 342/4 |
| 7,940,204 | B1 * | 5/2011 | Winebrand et al. | 342/4 |
| 8,106,810 | B2 * | 1/2012 | Holly et al. | 342/1 |
| 8,164,506 | B2 * | 4/2012 | Sim et al. | 342/4 |
| 2003/0011504 | A1 * | 1/2003 | Aknin | 342/2 |
| 2004/0104836 | A1 * | 6/2004 | Mukasa et al. | 342/1 |
| 2006/0208746 | A1 * | 9/2006 | Garreau et al. | 324/627 |
| 2007/0075910 | A1 * | 4/2007 | Kudou et al. | 343/841 |
| 2007/0296624 | A1 * | 12/2007 | Katano | 342/1 |
| 2009/0021416 | A1 * | 1/2009 | Asaba | 342/4 |
| 2011/0095932 | A1 * | 4/2011 | Winebrand et al. | 342/4 |
| 2011/0133977 | A1 * | 6/2011 | Park et al. | 342/1 |
| 2011/0279301 | A1 * | 11/2011 | Liu | 342/4 |
| 2011/0298673 | A1 * | 12/2011 | Zhang | 343/703 |
| 2012/0162001 | A1 * | 6/2012 | Sim | 342/4 |

OTHER PUBLICATIONS

Wojciech J. Krzysztofik, et al., "Design of Small Reverberation Chamber for Handsets Testing", Microwaves, Radar and Wireless Communications, 2008., pp. 1-4, May 2008.

Kwang-Soon Lee, et al., "Electromagnetic Field Distribution Analysis of Reverberation Chamber using Electromagnetic Diffusion Method", the Journal of Korean Institute of Electromagnetic Engineering and Science, vol. 11, No. 5, pp. 839-848, Aug. 2000.

* cited by examiner

INDOOR ELECTROMAGNETIC ENVIRONMENT IMPLEMENTING STRUCTURE AND A CONSTRUCTING METHOD THEREOF

CROSS-REFERENCE TO RELATED APPLICATION

This application claims priority to and the benefit of Korean Patent Applications No. 10-2009-0121977 filed in the Korean Intellectual Property Office on Dec. 9, 2009 and No. 10-2010-0037563 filed therein on Apr. 22, 2010, the entire contents of which are incorporated herein by reference.

BACKGROUND OF THE INVENTION (a) Field of the Invention

The present invention relates to an indoor electromagnetic environment implementing structure and a constructing method thereof. Particularly, the present invention relates to an indoor electromagnetic wave environment implementing structure that is usable as a shield room and an electromagnetic wave reverberation chamber by using a cover for covering an electromagnetic wave absorber, and a constructing method thereof.

(b) Description of the Related Art

Recently, as the electrical and electronic industry and radio wave techniques have been developed, wireless devices have been more widely used and combined with other devices, and applied to various wireless communication services.

The above-noted radio wave using techniques have been applied to various fields as well as the corresponding devices and communication services to provide many advantages, but on the other hand, the number of devices and services that are usable in a restricted area has increased to degrade the electromagnetic wave environment and generate many problems. Therefore, it is required to measure and estimate mutual influences of electromagnetic waves in an environment similar to real conditions in order to acquire accurate information on the operation and performance of the corresponding devices and services. Accordingly, for this purpose, techniques for building an actual electromagnetic wave implementation condition such as houses, offices, or vehicles where we live or that we use for the indoor electromagnetic wave condition separated from the outdoor electromagnetic waves are needed.

To measure the electromagnetic waves in the electromagnetic wave implementation environment, a substantial electromagnetic wave field distribution for the indoor space must be realized, and for this purpose, a structure or method for expressing the phenomenon in which the electromagnetic waves are radiated from the interior toward the exterior through a window or a door is needed. However, a measuring facility must be separated from the outdoor environment in order to guarantee accuracy and reliability of measurement. Particularly, since there are radios for business purpose requiring registration from among the wireless devices, a technique for expressing the phenomenon that the electromagnetic waves are radiated to the outside but preventing the actual radiation must also be developed for measurement by use of the devices.

In addition, in order to solve the above-noted problems, a measurement facility for realizing the effect of intercepting the electromagnetic waves that flow into the interior from the exterior by installing a shield room on the outer wall of a building and the electromagnetic waves that are output by a measuring device from the interior toward the exterior, and realizing the phenomenon of outputting the electromagnetic waves generated by an electromagnetic wave source in a room through a door and a window by using an electromagnetic wave absorber for the door and the window, thereby building the electromagnetic wave environment in our everyday space, has been developed.

However, since this measurement facility is difficult to generally use for measuring electromagnetic compatibility (EMC) because of internal fields formed by an electromagnetic wave absorber, the measurement facility cannot compatibly perform EMC measurement in the case of indoor and general EMC measurement.

In this instance, the EMC represents the ability of a device, equipment, or a system to function satisfactorily in its electromagnetic environment without introducing intolerable electromagnetic disturbances to anything in that environment. That is, its definition according to the dictionary signifies performance of an artificial system can fully generate without outputting electromagnetic energy, such as polluting the electromagnetic wave environment and interfering with others, and simultaneously without being influenced by the electromagnetic wave environment. The determinants of performance of the electronic system include whether the system is appropriately operable in a predetermined electromagnetic wave environment and whether the system is designed to not be a noise source in the electromagnetic wave environment.

That is, the existing measurement facility is only applicable to specific measurements caused by the corresponding environment, and hence, a method for constructing a facility that is applicable to the current electromagnetic interference/electromagnetic susceptibility (EMI/EMS) as well as the environment of the corresponding internal field is required.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an indoor electromagnetic environment implementing structure for using an EMC measurement facility in an actual indoor state as a general EMC measurement facility, and a constructing method thereof.

An exemplary embodiment of the present invention provides an indoor electromagnetic wave environment implementing structure, including: a shield room in a polyhedron structure for blocking electromagnetic waves output from the interior toward the exterior thereof and electromagnetic waves input from the exterior toward the interior when measuring a characteristic of the electromagnetic waves; an electromagnetic wave absorber installed at a door and a window on a wall through which the electromagnetic waves are output in the shield room; and a cover for covering the electromagnetic wave absorber with a size corresponding to the electromagnetic wave absorber.

Another embodiment of the present invention provides a method for constructing an indoor electromagnetic environment implementing structure, including: installing a shield room in a polyhedron structure for blocking electromagnetic waves output from the interior toward the exterior and electromagnetic waves input from the exterior toward the interior when measuring a characteristic of the electromagnetic waves; installing an electromagnetic wave absorber at a door and a window on a wall through which the electromagnetic waves are output in the shield room; and installing a cover for covering the electromagnetic wave absorber with a size corresponding to the electromagnetic wave absorber, wherein the cover transmits or blocks the electromagnetic waves according to utilization of electromagnetic wave measurement tests.

DETAILED DESCRIPTION OF THE EMBODIMENTS

Figure 1:
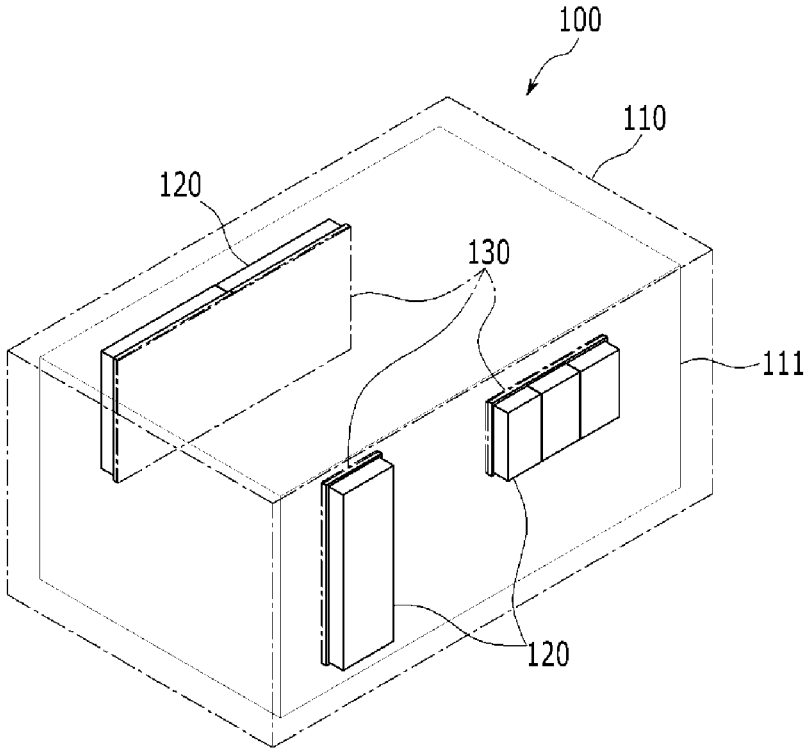
FIG. 1 shows a perspective view of an indoor electromagnetic environment implementing structure according to an embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout the specification, unless explicitly described to the contrary, the word "comprise" and variations such as "comprises" or "comprising" will be understood to imply the inclusion of stated elements but not the exclusion of any other elements.

Throughout the specification, EMC measurement includes measurement of electromagnetic susceptibility (EMS) for showing performance for a device or a circuit to process undesired noise, measurement of electromagnetic interference (EMI) for indicating a device that may cause electromagnetic interference, and measurement of radiated EMC and conducted EMC.

An indoor electromagnetic wave environment implementing structure according to an exemplary embodiment of the present invention and a constructing method thereof will now be described in detail with reference to the accompanying drawings.

FIG. 1 shows a perspective view of an indoor electromagnetic environment implementing structure according to an embodiment of the present invention.

Referring to FIG. 1, the indoor electromagnetic environment implementing structure 100 includes a shield room 110 for intercepting electromagnetic waves output from the interior toward the exterior and electromagnetic waves input thereto when measuring a characteristic of the electromagnetic waves, an electromagnetic wave absorber 120 installed on a door and a window of a wall 111 for outputting the electromagnetic waves from the inside of the shield room 110, and a cover 130 for covering the absorber with a size corresponding to the electromagnetic wave absorber 120.

The shield room 110 is installed on an outer wall of a polyhedron-shaped building to intercept electromagnetic waves provided from the outside, and intercepts the electromagnetic waves output from the interior toward the exterior by a measurement device in the case of measuring the electromagnetic waves. In this instance, at least one open window and a door are formed in the wall 111 of the shield room 110.

The electromagnetic wave absorber 120 is configured to fit the sizes of the door and the window in order to realize the electromagnetic wave environment output from the interior toward the exterior through the door and window, and the electromagnetic wave absorber 120 is provided outside the inner wall 111 of the shield room 110.

The cover 130 is formed with the same material as the shield room 110 for covering the area in which the electromagnetic wave absorber 120 is installed, and it is installed to be the same surface as the inner wall 111 of the shield room 110. That is, the cover 130 can be installed to correspond to the sizes of the door and the window.

The electromagnetic wave environment implementing structure 100 has a characteristic of providing an electromagnetic environment implementing structure for using both an EMC measurement facility in the actual indoor state and a general EMC measurement facility, which will now be described in detail in a subsequent exemplary embodiment.

Figure 2:
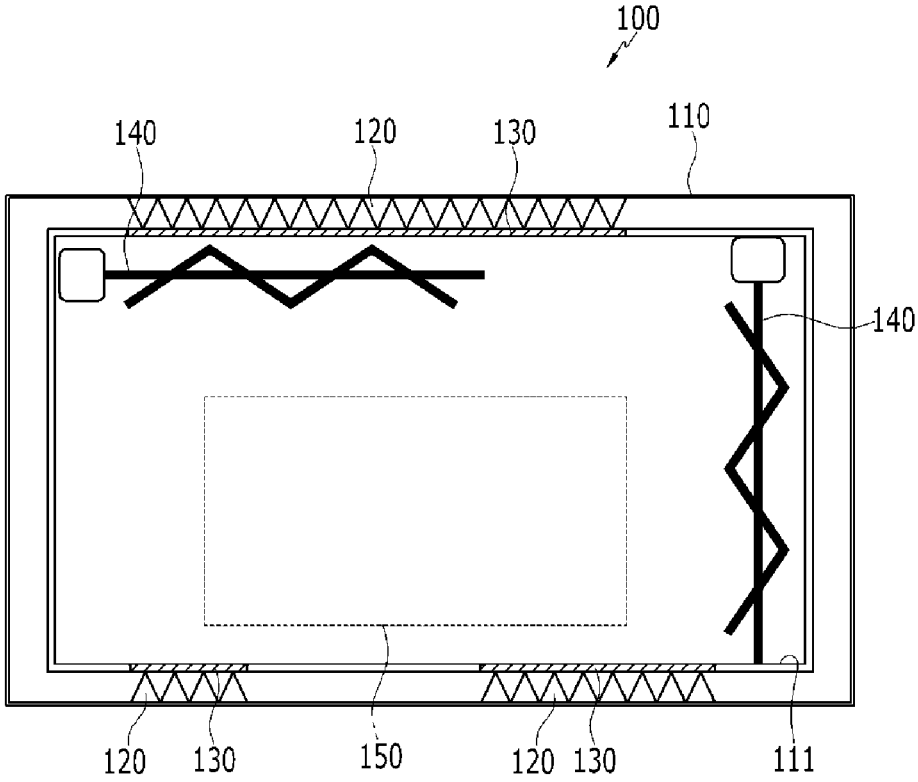
FIG. 2 shows a top plan view of an indoor electromagnetic environment implementing structure when used as a general EMC measurement facility according to a first exemplary embodiment of the present invention.

FIG. 2 shows a top plan view of an indoor electromagnetic environment implementing structure when used as a general EMC measurement facility according to a first exemplary embodiment of the present invention.

Referring to FIG. 2, the top plan view of the indoor electromagnetic environment implementing structure 100 is based on the perspective view of FIG. 1, and it shows that the cover 130 designed with the same material as the shield room 110 is installed on the structure in which the door and the window are designed by the electromagnetic wave absorber 120.

In detail, the outer wall of the indoor electromagnetic wave environment implementing structure 100 is designed in a box shape by using the shield room 110, and the door and the window in the wall 111 for outputting the electromagnetic waves is designed by using the electromagnetic wave absorber 120. In this instance, the electromagnetic wave absorber 120 is configured to be inside the inner wall 111 of the shield room 110.

The cover 130 for covering the electromagnetic wave absorber 120 is the same size as the exposed area of the electromagnetic wave absorber 120 when the cover 130 is viewed from the inside of the shield room 110, and it is designed with the same material as the shield room 110. Also, it is desirable for the cover 130 to be installed to be the same surface as the inner wall 111 of the shield room, and the cover 130 includes an opening/closing means for transmitting or blocking the electromagnetic waves according to utilization of electromagnetic wave measurement tests. Here, regarding the opening/closing means, as an example, the cover 130 can be designed to selectively transmit or block the electromagnetic waves by applying the cover 130 to an opening/closing structure such as a blind, a partition, or a shutter.

The electromagnetic wave environment implementing structure 100 can measure the electromagnetic waves of various target devices such as a small portable terminal or a vehicle, and it is accordingly needed to control the sizes of the door, the electromagnetic wave absorber 120, and the cover 130 to satisfy the sizes of the targets.

According to the first exemplary embodiment of the present invention, the cover 130 of the indoor electromagnetic wave environment implementing structure 100 covers the door and the window to block the electromagnetic waves, and it can be used as an EMC measurement facility in a like manner of the shield room.

Particularly, as shown in FIG. 2, it can be used as a test site such as an electromagnetic reverberation chamber by generating a uniform electric field volume 150 by additionally forming a stirrer 140.

Figure 3:
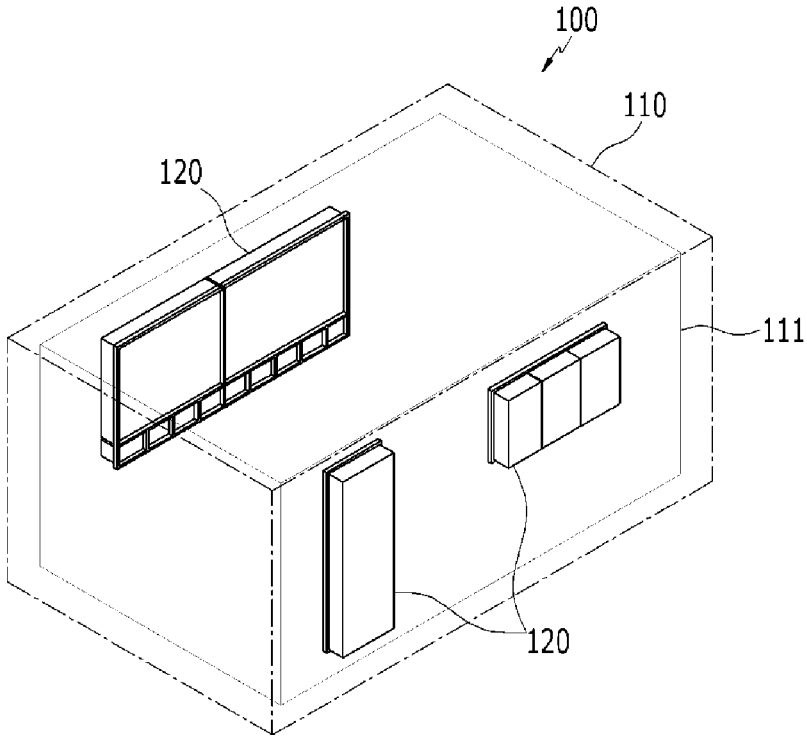
FIG. 3 shows a perspective view of an indoor electromagnetic environment implementing structure for measuring electromagnetic wave in an indoor state according to a second exemplary embodiment of the present invention.

FIG. 3 shows a perspective view of an indoor electromagnetic environment implementing structure for electromagnetic wave in an indoor state according to a second exemplary embodiment of the present invention.

Figure 4:
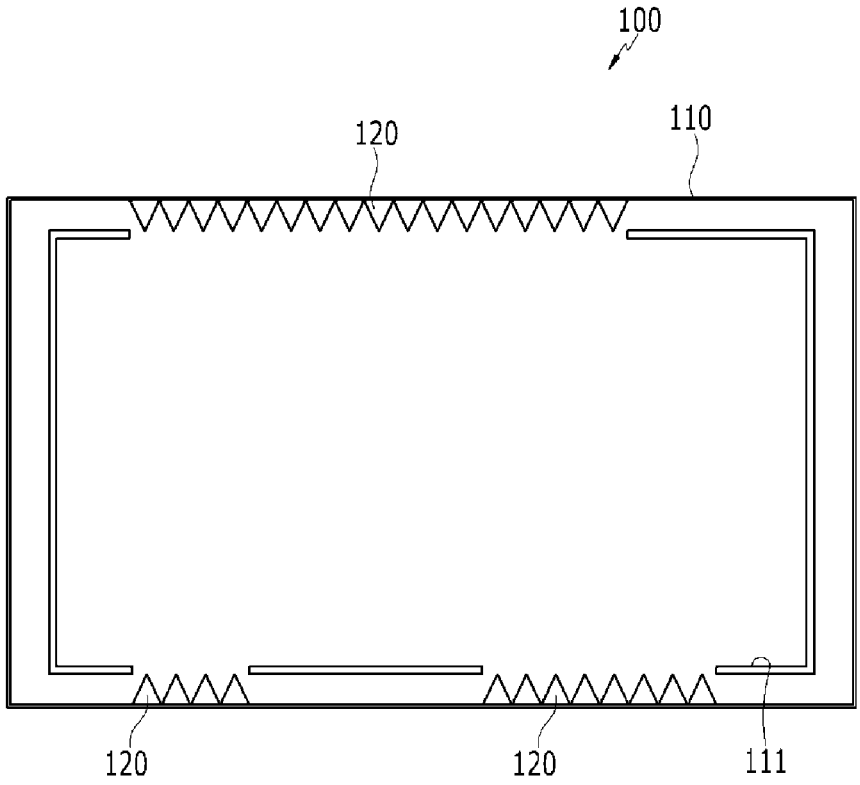
FIG. 4 shows a top plan view of an indoor electromagnetic environment implementing structure for measuring electromagnetic wave in an indoor state according to a second exemplary embodiment of the present invention.

FIG. 4 shows a top plan view of an indoor electromagnetic environment implementing structure for measuring electromagnetic wave in an indoor state according to a second exemplary embodiment of the present invention.

Referring to FIG. 3 and FIG. 4, the indoor electromagnetic environment implementing structure for measuring electromagnetic wave is similar to that of FIG. 1 according to an exemplary embodiment of the present invention, but the opened state of the cover 130 is different.

That is, since the outer wall uses the shield room 110 in a like manner of the first exemplary embodiment of the present invention, it is designed in the box shape (PEC) using the shield room, and the door and the window of the wall for outputting the electromagnetic waves to the outside are configured by using the electromagnetic wave absorber 120.

In this instance, the shield room 110 functions to intercept the electromagnetic waves output from the interior toward the exterior and the electromagnetic waves input to the interior, and the electromagnetic wave absorber 120 shows the field distribution of the electromagnetic waves output from the interior toward the exterior and can form an indoor field distribution of the electromagnetic waves changeable by the electromagnetic waves output to the exterior.

Therefore, according to the present invention, the indoor electromagnetic wave environment implementing structure 100 configures the cover 130 for covering the electromagnetic wave absorber 120 with the same material as the shield room 110, and it is used as an EMC measurement facility for an indoor condition when there is no cover 130 (i.e., the opened state), while it is used as an electromagnetic reverberation chamber by installing a stirrer or a shield room when there is a cover 130, thereby expecting an increase of utilization on the constructed measurement facility.

Utilization of the electromagnetic wave reverberation chamber will now be described with reference to FIG. 5.

Figure 5:
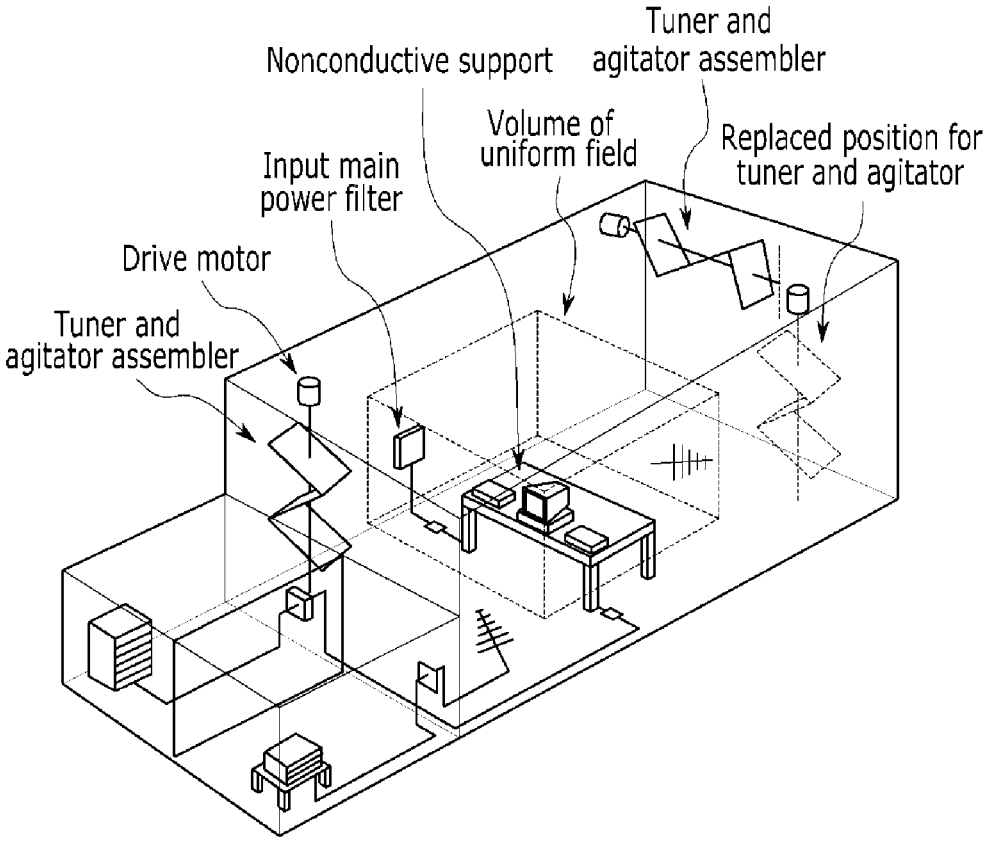
FIG. 5 shows a structure of an electromagnetic wave reverberation chamber according to an exemplary embodiment of the present invention.

FIG. 5 shows a structure of an electromagnetic reverberation chamber according to an exemplary embodiment of the present invention.

Referring to FIG. 5, the electromagnetic reverberation chamber represents a shield room having the smallest area that can be increased according to the wavelength from the lowest usable frequency, and it can be a chamber used to measure the electromagnetic waves of electrical equipment or a closed and sealed cavity with great electricity and conductivity. The bottom frequency is determined by the mode number for gaining uniformity of an electric field in the reverberation chamber, and a stirrer or a diffuser is generally used to obtain uniformity of the electric field for the purpose of lowering the bottom frequency of the reverberation chamber.

The total number of modes that can be generated within the reverberation chamber must be considered in advance in the case of designing the electromagnetic reverberation chamber, and it is changeable by the frequency and the volume of the reverberation chamber. Therefore, in the present invention, the shield room 110 that is the outer wall of the building is installed in consideration of the frequency and the volume of the reverberation chamber, and the cover 130 for covering the electromagnetic wave absorber 120 is used to obtain field uniformity within the electromagnetic reverberation chamber by installing a stirrer in the case of using it as an electromagnetic reverberation chamber.

According to an embodiment of the present invention, a cover for covering an electromagnetic absorber of the same material is configured, and the present invention is used as an EMC measurement facility in the indoor condition when no cover is provided, while it is used as an electromagnetic reverberation chamber or a shield room by installing a stirrer when a cover is provided, thereby expecting an increase of usability of the constructed measurement facility.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An indoor electromagnetic wave environment implementing structure comprising:

a shield room in a polyhedron structure for blocking electromagnetic waves output from the interior toward the exterior thereof and electromagnetic waves input from the exterior toward the interior when measuring a characteristic of the electromagnetic waves;

an electromagnetic wave absorber installed at a door and a window on a wall through which the electromagnetic waves are output in the shield room; and a cover covering the electromagnetic wave absorber with a size corresponding to the electromagnetic wave absorber, such that the cover prevents the electromagnetic waves output from the interior from being absorbed by the electromagnetic wave absorber.

2. The indoor electromagnetic wave environment implementing structure of claim 1, wherein the electromagnetic wave absorber is configured to be an opened size of the door and the window and is provided outside the inner wall of the shield room.

3. The indoor electromagnetic wave environment implementing structure of claim 1, wherein the cover is configured with the same material as the shield room and is installed as the same surface as the inner wall of the shield room.

4. The indoor electromagnetic wave environment implementing structure of claim 3, wherein the cover can be opened and closed by an opening and closing means, and the cover is closed to intercept the electromagnetic waves when electromagnetic compatibility is measured in a closed and sealed space, and the cover is opened to output the electromagnetic waves to the outside when electromagnetic compatibility in the inner field environment is measured.

5. The indoor electromagnetic wave environment implementing structure of claim 4, wherein the opening and closing means has and closing a structure of a blind, a partition, or a shutter.

6. The indoor electromagnetic wave environment implementing structure of claim 4, wherein the indoor electromagnetic wave environment implementing structure further includes a stirrer for reducing a bottom frequency and that is used for a reverberation chamber when the cover is closed.

7. A method for constructing an indoor electromagnetic environment implementing structure, comprising:

installing a shield room in a polyhedron structure for blocking electromagnetic waves output from the interior toward the exterior and electromagnetic waves input from the exterior toward the interior when measuring a characteristic of the electromagnetic waves;

installing an electromagnetic wave absorber at a door and a window on a wall through which the electromagnetic waves are output in the shield room; and installing a cover to cover the electromagnetic wave absorber with a size corresponding to the electromagnetic wave absorber, such that the cover prevents the electromagnetic waves output from the interior from being absorbed by the electromagnetic wave absorber, wherein the cover transmits or blocks the electromagnetic waves according to utilization of electromagnetic wave measurement tests.

8. The method of claim 7, wherein the cover is formed with the same material of the shield room and is installed on the same plane as the inner wall of the shield room.

9. The method of claim 7, wherein the method includes, after the installing of a cover:

intercepting the electromagnetic waves by closing the cover when electromagnetic compatibility in a closed and sealed space is measured; and outputting the electromagnetic waves by opening the cover when electromagnetic compatibility in an inner field environment of a building is measured.

10. The method of claim 9, wherein the intercepting of electromagnetic waves further includes a stirrer for reducing a bottom frequency to be used as a reverberation chamber.

* * * * *